US005813158A

United States Patent [19]

Campbell et al.

[11] Patent Number: 5,813,158

[45] **Date of Patent: *Sep. 29, 1998**

[54] FIREARMS

[75] Inventors: Hugh Alexander Campbell, Inverness; Ian Fraser Thompson, Cromarty, both of United Kingdom

[73] Assignee: Thompson & Campbell Limited, United Kingdom

[ * ] Notice: The term of this patent shall not extend beyond the expiration date of Pat. No. 5,787,629.

[21] Appl. No.: 828,641

[22] Filed: Mar. 31, 1997

Related U.S. Application Data

[62] Division of Ser. No. 719,131, Sep. 24, 1996.

[30] Foreign Application Priority Data

Sep. 28, 1995 [GB] United Kingdom ..... 9519963

[51] Int. Cl.[6] ..... F41A 21/00

[52] U.S. Cl. ..... 42/75.03; 42/71.01

[58] Field of Search ..... 42/75.03, 71.01

[56] References Cited

U.S. PATENT DOCUMENTS

| | | | |
|---|---|---|---|
| 963,444 | 7/1910 | Johnson | 42/75.03 |
| 1,047,690 | 12/1912 | Oliver | 42/73 |
| 1,583,616 | 3/1926 | Smith | 42/75.03 |
| 2,078,591 | 9/1937 | Sprague | 42/85 |
| 2,187,640 | 1/1940 | Bost | 42/75 |
| 2,844,904 | 7/1958 | Butler | 42/75 |
| 3,683,535 | 8/1972 | Lewis | 42/71 P |
| 3,830,003 | 8/1974 | Clerke | 42/75 C |
| 4,012,859 | 3/1977 | Johansson et al. | 42/75 |
| 4,651,455 | 3/1987 | Geiser, Jr. | 42/18 |
| 4,685,237 | 8/1987 | Hugg | 42/85 |
| 4,884,354 | 12/1989 | Senfter | 42/73 |
| 4,964,232 | 10/1990 | Mainland et al. | 42/44 |

*Primary Examiner*—Charles T. Jordan
*Assistant Examiner*—Meena Chelliah
*Attorney, Agent, or Firm*—Heslin & Rothenberg, P.C.

[57] ABSTRACT

There is disclosed an improved firearm, and in particular an improved rifle such as a bolt action rifle. Known rifles suffer from a number of problems, for example, accuracy, ease of disassembly, ease of assembly and realignment. Accordingly there is provided a rifle 5 comprising a stock 10 and an action 25 seated in the stock, the stock comprising a forestock 15 and a buttstock 20, wherein there are provided means for connecting a foremost end of the buttstock 20 to the action 25. The connection means allow the stock 10 and the action 25 to be releasably connecting one with the other.

18 Claims, 8 Drawing Sheets

FIREARMS

This application is a division of application Ser. No. 08/719,131 filed Sep. 24, 1996 which application is now pending.

BACKGROUND OF THE INVENTION

This invention relates to firearms and in particular, though not exclusively, to rifles such as bolt action rifles.

Bolt action sporting/hunting/target rifles are known, and have changed little since the end of the 19th century. Examples of bolt action rifles are the Mauser Model 98, the Sako Finnbear, the Remington Model 700 and the Sauer 200. In such rifles the breech-block takes the form of a manually operated sliding rod.

A number of problems exist with known bolt action rifles. For example accuracy, ease of disassembly, ease of assembly and realignment.

It is also known to provide sling swivels, mounted on studs normally on the forestock and buttstock of a rifle, so as to facilitate the attachment of a sling (or strap) thereto for the purpose of carrying the rifle - normally over the shoulder.

A problem exists with known studs in that they protrude from the forestock/buttstock when not in use. This may cause the stud to be a nuisance to a Marksman, and may also lead to the stud becoming blocked with dirt/mud or the like.

It is an object of at least some aspects of the present invention to obviate or mitigate at least some of the aforementioned problems in the prior art.

SUMMARY OF THE INVENTION

According to a first aspect of the present invention there is provided a rifle comprising a stock and an action seated in the stock, the stock comprising a forestock and a buttstock, wherein there are provided means for connecting a foremost end of the buttstock to the action.

Preferably the connection means allow the stock and the action to be releasably connected one with the other.

Preferably the connection means comprises a bolt retained within a hole formed through the foremost end of the buttstock, an end of the bolt being threadably connected to a threaded hole provided on the action.

Preferably a first end of the hole is provided on a pistol grip provided at the foremost end of the buttstock.

Preferably a second end of the hole is provided on a surface of a seat provided on the stock, the seat being adapted to receive the action.

Preferably a bedding plate is provided on the seat around the second end of the hole.

Preferably the bedding plate further provides a cylindrical member which extends within the hole, and which is preferably a tight fit therein.

The bedding plate and cylindrical member are preferably manufactured as a sub-assembly prior to being utilised to connect the action to the stock.

Preferably the rifle may be assembled/dissembled by attaching/releasing the stock and action one from the other by means of the connection means.

Preferably the rifle may be a bolt action rifle.

However, the rifle may be a pump or lever action rifle.

The stock comprising the forestock and buttstock may preferably be provided in one integral piece, or alternatively in two separate/separable pieces.

According to a second aspect of the present invention there is provided a stock adapted for use in a rifle according to the first aspect of the invention.

According to a third aspect of the present invention there is provided an action adapted for use in a rifle according to the first aspect of the invention.

According to a fourth aspect of the present invention there is provided a rifle comprising a stock and an action wherein there is provided means for releasably connecting the stock and the action.

The releasable connection means may preferably connect a foremost end of the buttstock to the action.

The releasable connection means may comprise one or more bolts having heads adapted to receive a polygonal pin key.

Preferably the releasable connection means allow the stock and the action to be releasably connected one with the other.

Preferably the releasable connection means comprises a bolt retained within a hole formed through the foremost end of the buttstock, an end of the bolt being threadably connected to a threaded hole provided on the action.

Preferably a first end of the hole is provided on a pistol grip provided at the foremost end of the buttstock.

Preferably a second end of the hole is provided on a surface of a seat provided on the stock, the seat being adapted to receive the action.

Preferably a bedding plate is provided on the seat around the second end of the hole.

Preferably the bedding plate further provides a cylindrical member which extends within the hole, and which is preferably a tight fit therein.

The bedding plate and cylindrical member are preferably manufactured as a sub-assembly prior to being utilised to connect the action to the stock.

Preferably the rifle may be assembled/dissembled by attaching/releasing the stock and action one from the other by means of the connection means.

Preferably the rifle may be a bolt action rifle.

However, the rifle may be a pump or lever action rifle.

The stock comprising the forestock and buttstock may preferably be provided in one integral piece or alternatively in two separate/separable pieces.

According to a fifth aspect of the present invention there is provided a stock adapted for use in a rifle according to the fourth aspect of the invention.

According to a sixth aspect of the present invention there is provided a stock adapted for use in a rifle according to the fifth aspect of the invention.

According to a seventh aspect of the present invention there is provided a stud for a sling swivel for use in a firearm, the stud comprising a first body intended to be received within a recess formed in a firearm, a second body having means to allow connection of a sling swivel to the stud, and means for moving the first and second bodies between first and second positions relative to one another such that, in use, in the first position the second body is intended to be retained within the recess, and in the second position the second body is intended to stand proud of the recess so as to allow the sling swivel to be connected thereto.

Preferably the firearm is a rifle, the recess being formed in a stock thereof.

Preferably the first body comprises a hollow cylindrical member.

Preferably the second body comprises a cylindrical member which in its first position is received within the first body.

Preferably, the second body provides an aperture extending transversely therethrough, the aperture forming the connection means.

Preferably the means for moving the first and second bodies between first and second positions comprises bayonet type connection means formed on the second body and on a third cylindrical body which third body is provided within the first body and which third body accepts the second body and which means further comprises means for biasing the second body from the first to the second position.

Where the firearm is a rifle, preferably first and second studs are provided on lower facing surfaces of a forestock and a buttstock of the rifle, respectively.

Preferably, the rifle is a bolt action rifle.

However, the rifle may be a pump or lever action rifle.

According to an eighth aspect of the present invention there is provided a firearm having at least one stud according to the seventh aspect of the invention.

According to a nineth aspect of the present invention there is provided a sling swivel for use with a firearm, the sling swivel comprising a first body intended to be received within a recess formed in a firearm, a second body having means to allow connection of the sling swivel to a strap, and means for moving the first and second bodies between first and second positions relative to one another such that, in use, in the first position the second body is intended to be retained within the recess, and in the second position the second body is intended to stand proud of the recess.

Preferably the means to allow connection comprise an eye releasably connectable to the second body.

DESCRIPTION OF THE DRAWINGS

An embodiment of the present invention will now be described, by way of example only, with reference to the accompanying drawings in which are shown.

DETAILED DESCRIPTION OF THE DRAWINGS

Figure 1:
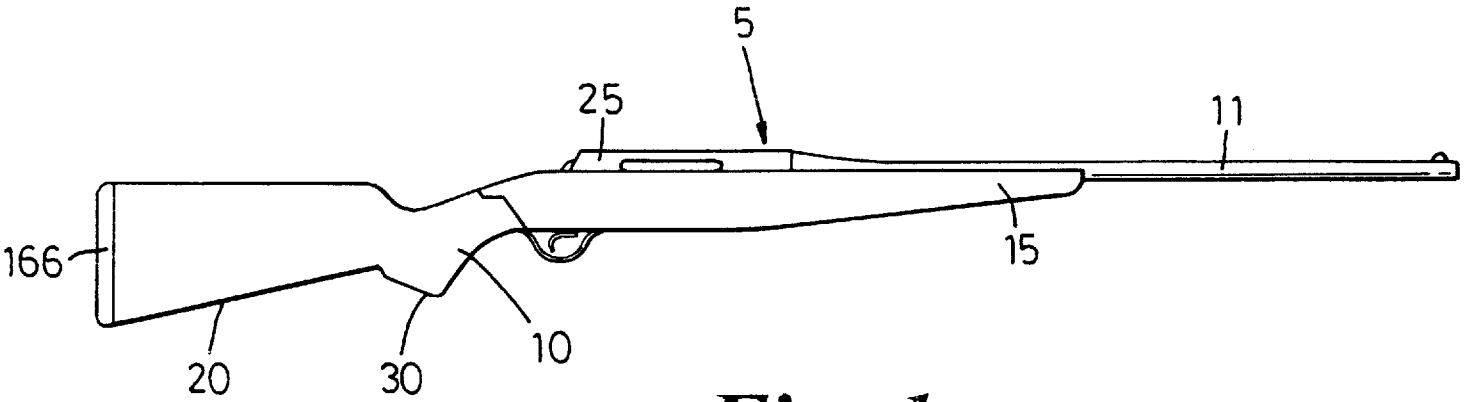
FIG. 1 a side view of a rifle according to an embodiment of the present invention.
Figure 2:
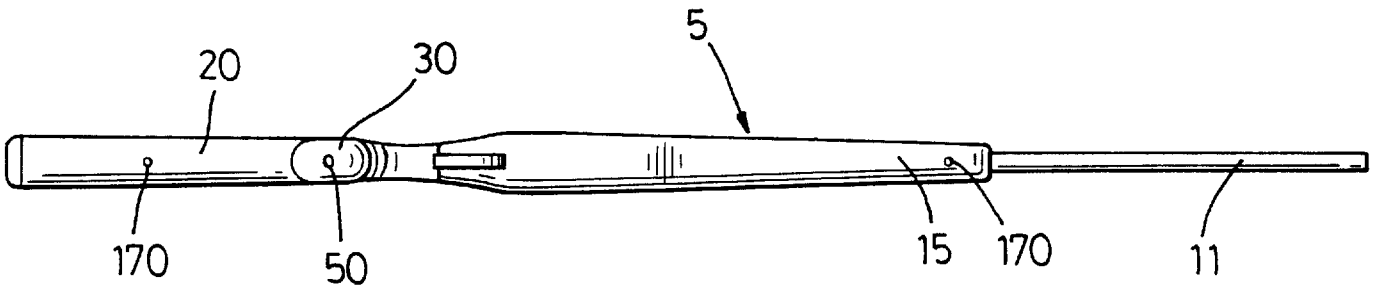
FIG. 2 a view from below the rifle of FIG. 1.
Figure 3:
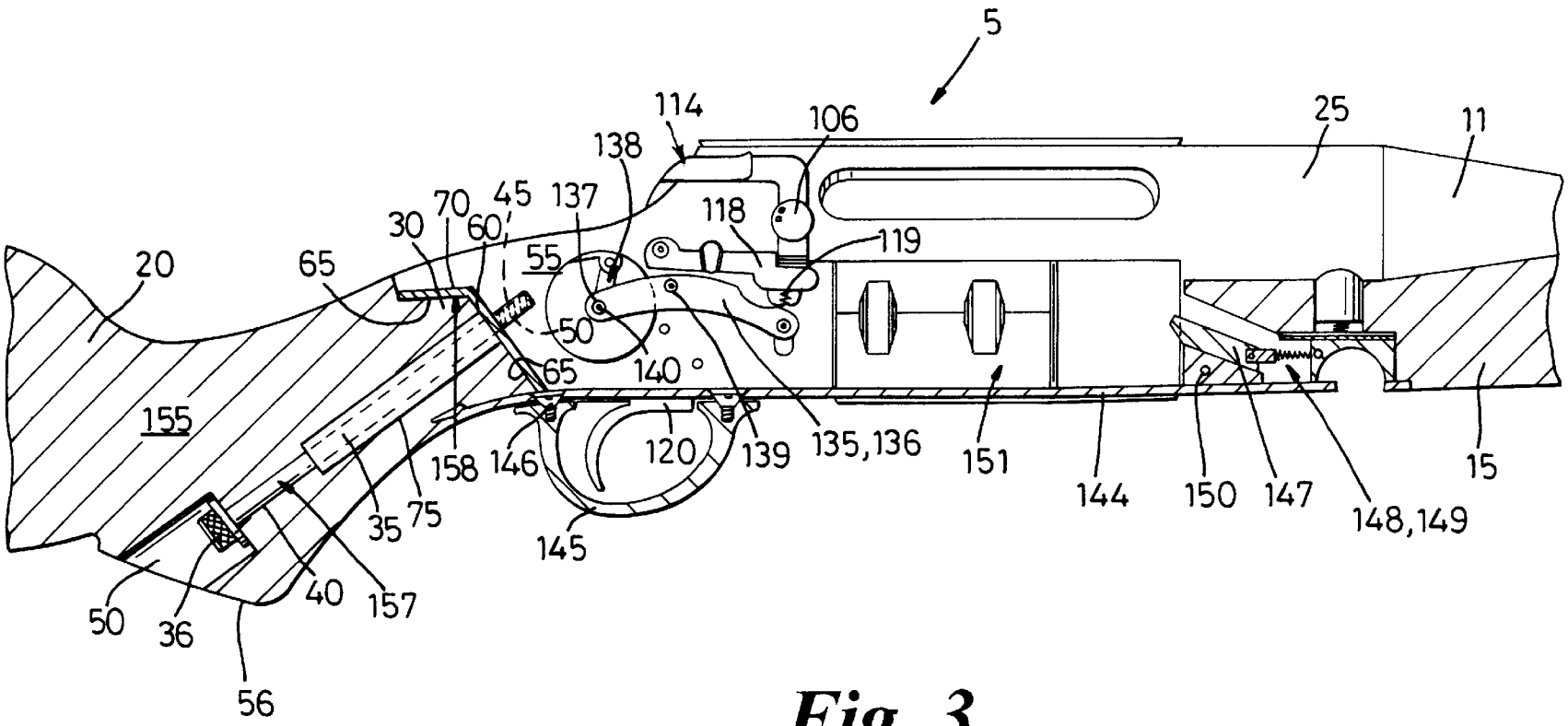
FIG. 3 a partially sectioned side view of part of the rifle of FIG. 1.
Figure 4:
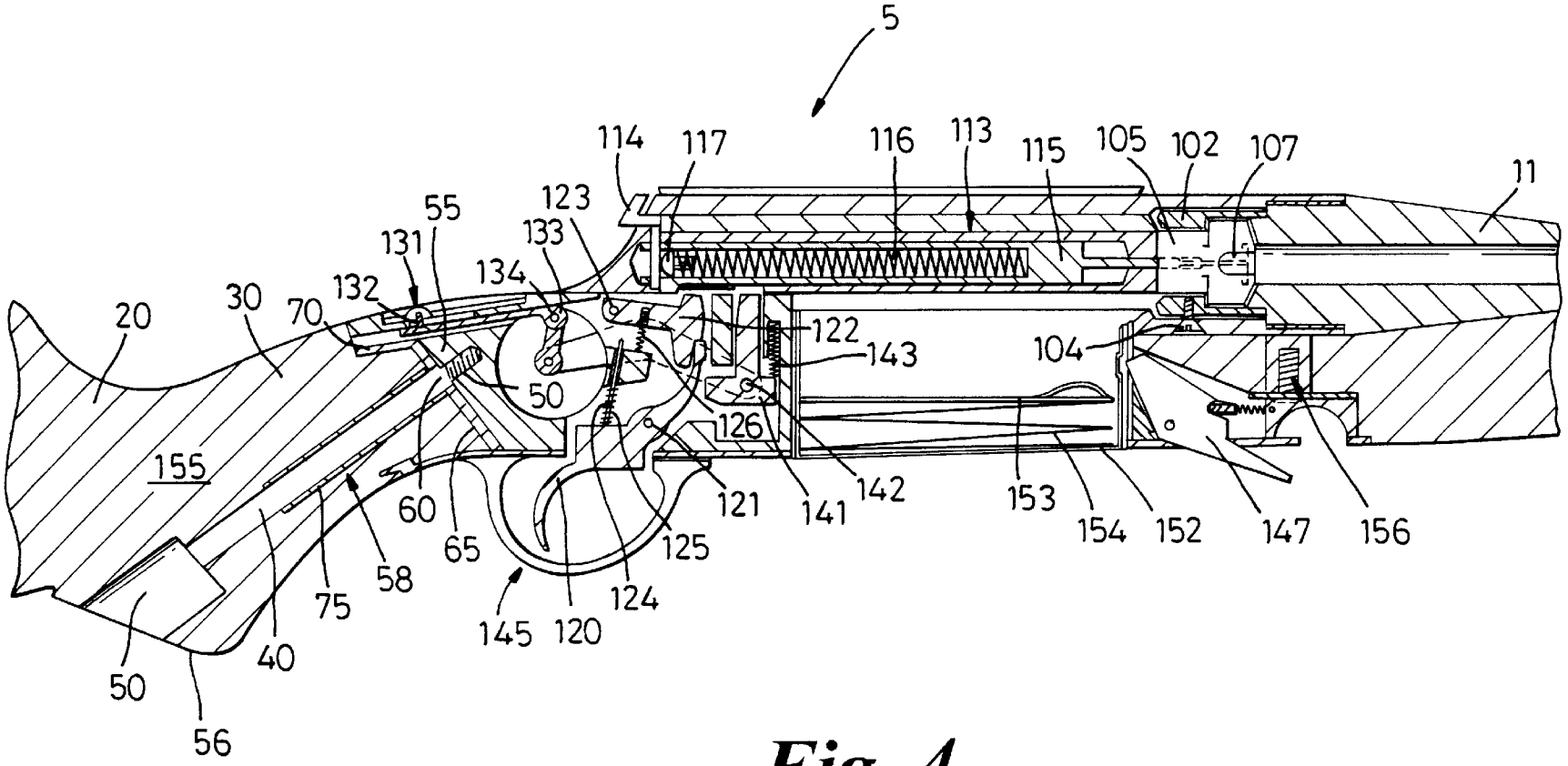
FIG. 4 a fully sectioned side view of the part of the rifle of FIG. 1.

Referring firstly to FIGS. 1 to 4 there is illustrated a bolt action rifle, generally designated 5, according to an embodiment of the present invention. The rifle 5 comprises a stock 10 having a fore portion referred to hereinafter as a forestock 15, and an aft portion referred to hereinafter as a buttstock 20. The rifle 5 further comprises an action 25 seated in the stock 10. Herein the term "action" is intended to signify a loading mechanism and firing mechanism as well as a barrel 11 of the rifle 5.

Means are provided for connecting a foremost end 30 of the buttstock 20 to the action 25. The connection means comprise a bolt 35 retained within a hole 40 passing through the foremost end 30 of the buttstock 20, an end 45 of the bolt 35 being threadably connected to an internally threaded hole 50 provided at a rearmost end 55 of the action 25. In this embodiment the bolt 35 has a head 36 capable of receiving a polygonal pin key such as an Allen key.

A first end 50 of the hole 40 is provided on a pistol grip 56 at the foremost end 30 of the buttstock 20. A second end 60 of the hole 40 is provided on a surface of a seat 65 provided on the stock 10, the seat 65 being adapted to receive the action 25.

A bedding plate 70, in this embodiment made of a metal such as steel having a through-hole, is provided on the seat 65 around the second end 60 of the hole 50. The bedding plate 70 further provides a hollow cylindrical member 75 extending from the through-hollow into the hole 50, the cylindrical member 75 being a tight fit therein. The bedding plate 70 and cylindrical member 75 are manufactured so as to provide a single component prior to being utilised to connect the action 25 to the stock 10.

In use, the rifle 5 may be assembled/disassembled by attaching/releasing the stock 10 and action 25 one from the other by means of the bolt 35. It has been found that the rifle 5 so assembled requires little, if any, realignment before accurate firing may be obtained.

The rifle 5 comprises the following further parts:

locking collar 102,
locking collar screw 104,
bolt body (solid) 105,
handle (if fabricated) 106,
extractor claw 107,
extractor spring 108,
extractor plunger 109,
ejector plunger 110,
ejector stop 111,
ejector spring 112,
sleeve 113,
bolt safety 114,
striker 115,
main spring 116,
main spring cap 117,
bolt release 118,
bolt release spring 119,
trigger 120,
trigger pivot screw 121,
sear 122,
sear pivot screw 123,
trigger spring guide 124,
trigger spring 125,
sear spring 126,
trigger finger 127,
trigger arm 128,
double pull spring 129,
stop wire 130,
safety button 131,
safety button screw 132,
safety slide 133,
safety slide screw 134,
side arm l/h 135,
side arm r/h 136,
two spacers 137,
link 138, two side arm screws 139,
link pin (rivet) 140,
safety block 141,
safety block screw 142,
safety block spring 143,
floor plate 144,
guard 145,
two guard screws 146,
magazine catch 147,
magazine catch spring 148,
magazine catch spring guide 149,
magazine catch pivot screw 150,
magazine box 151,
bottom plate 152,
lifter 153,
spring 154,
stock 155,
stock bolt front 156,
stock bolt hand 157,
bedding plate 158,
recoil pad 166,
two studs for sling swivels 170.

The construction of preferred sling swivel studs 170 is described hereinafter.

Figure 5:
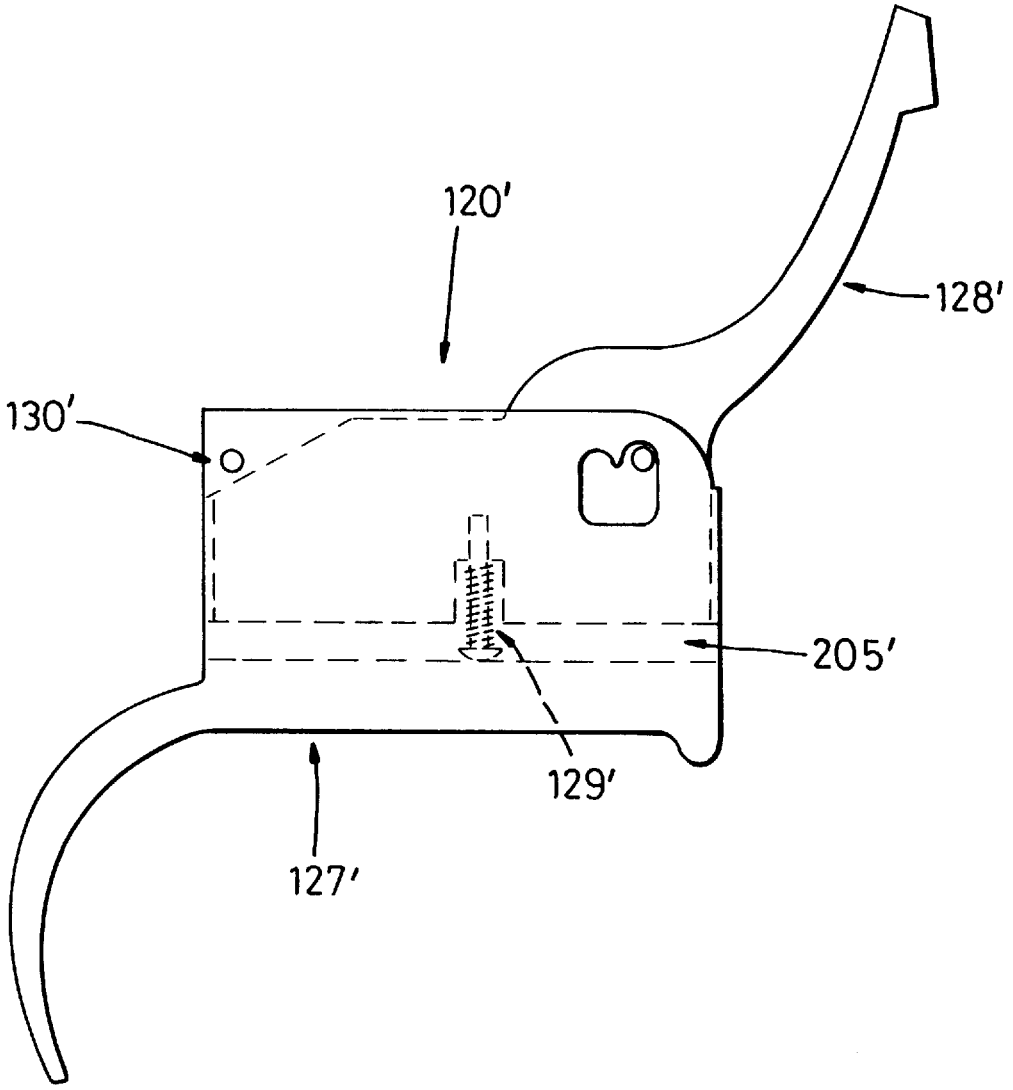
FIG. 5 a side view of a double pull trigger mechanism for use in the rifle of FIG. 1.
Figure 6:
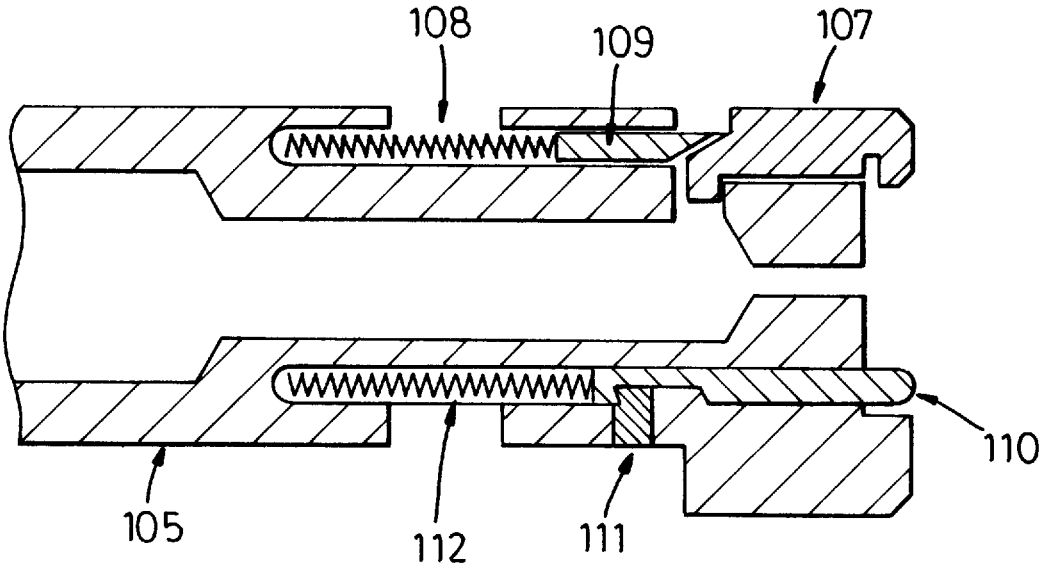
FIG. 6 a cross-sectional representation of an ejector and an extractor mechanism for use in the rifle of FIG. 1.
Figure 7:
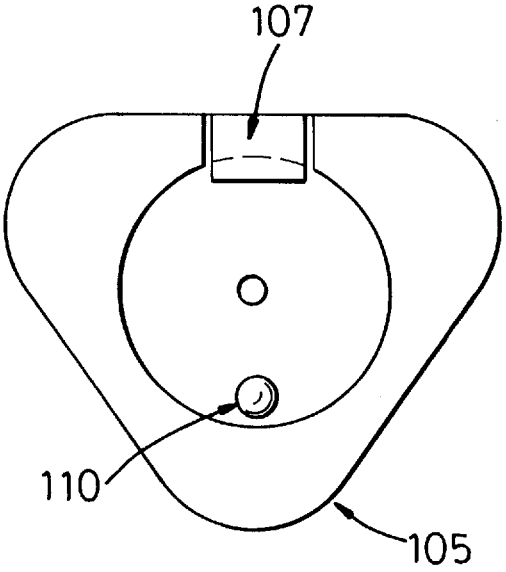
FIG. 7 a front view of a bolt body for use in the rifle of FIG. 1.

Referring to FIG. 5 there is shown an alternative embodiment of a double pull trigger mechanism 120' for use in the rifle 5, the trigger 120' comprising a trigger finger 127', a trigger arm 128', a double pull spring 129' and a stop wire 130'. The spring 129' biases the trigger finger 127' apart from the trigger arm 128', indicated by arrow 205', and thus a first movement of the trigger finger 127' is required to bring the finger 127' into contact with the arm 128'. Once contact is established between the arm 128' and the finger 127', a second movement of the finger 127' is required to displace the arm 128' and hence actuate the firing mechanism of the firearm. The double pull mechanism overcomes the problems inherent with single pull mechanisms, for example, their tendency to actuate the firearm if dropped or jarred, and provides greater feed back to the Marksman especially in adverse weather conditions.

Figure 8:
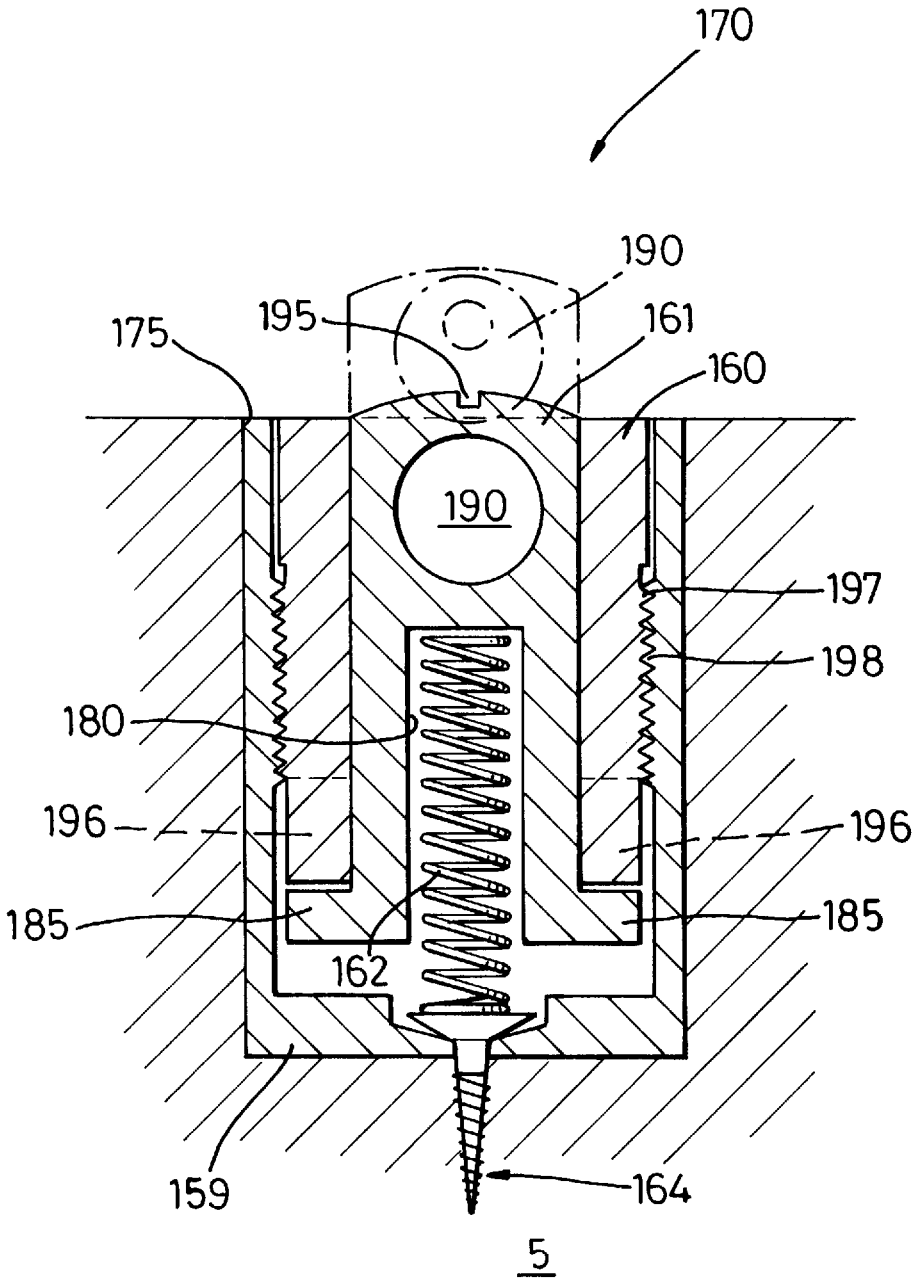
FIG. 8 a cross-sectional representation of a stud according to an embodiment of the present invention.
Figure 9:
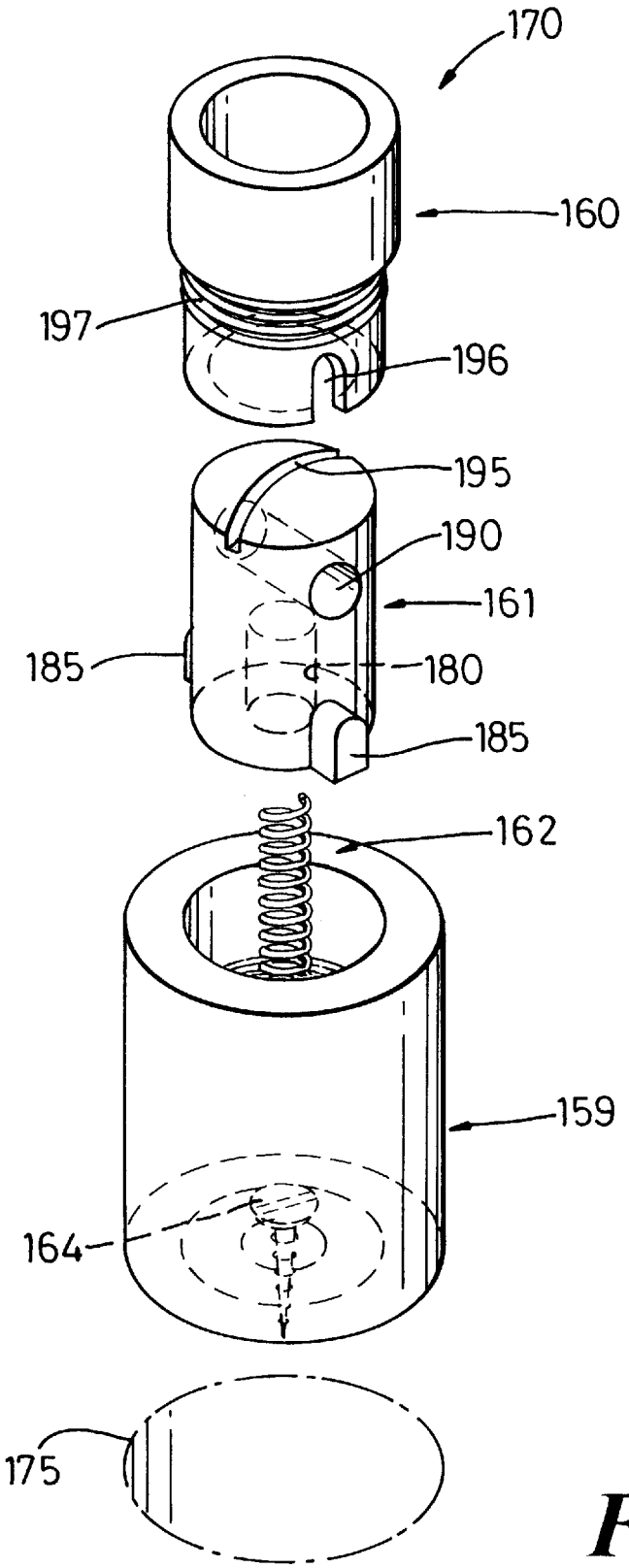
FIG. 9 an exploded view of the stud of FIG. 8.

Referring now to FIGS. 8 and 9 there is shown a retractable stud (assembly) 170 for a sling swivel according to an embodiment of the present invention comprising a first body in the form of cylindrical main socket 159, biasing means in the form of a spring 162, a second body in the form of a stud 161 and a third body in the form of a cover socket 160. The swivel assembly 170 may be provided within a cylindrical recess 175 present in the forestock or buttstock of a firearm such, as the rifle 5, and may be held in place with a screw 164.

The stud 161 is provided with a central hollow 180, a pair of horizontally opposed lugs 185 on a lower portion and an aperture 190 in an upper portion. A slot 195 is provided on the top of a stud 161. The cover socket 160 is provided with a pair of slots 196 able to accommodate the lugs 185 and a male thread 197 engagable with a corresponding female thread 198 present in the main socket 159.

In use the stud (assembly) 170 is assembled as shown in FIG. 5 with the spring 162 and the stud 161 captivated between the main socket 159 and the cover socket 160. The stud 161 may be provided in a retracted (first) or extended (second) position. In the extended position the lugs 185 of stud 161 align with the slots 196 in the cover socket 160 permitting the stud 161 to move outwards under the influence of the spring 162. In the retracted position the slots 196 and lugs 185 are misaligned and the top of the stud 161 is held substantially flush with the surface of the forestock or buttstock. The stud 161 may be moved from the retracted position to the extended position by depressing it against the spring 162 and moving it through a quarter turn.

In the extended position the upper portion of the stud 161 provided with the aperture 190 stands proud of the forestock or buttstock. A sling swivel or other such carrying device, as known in the art, may thus be attached to the stud 161 via the aperture 190.

Figure 10A:
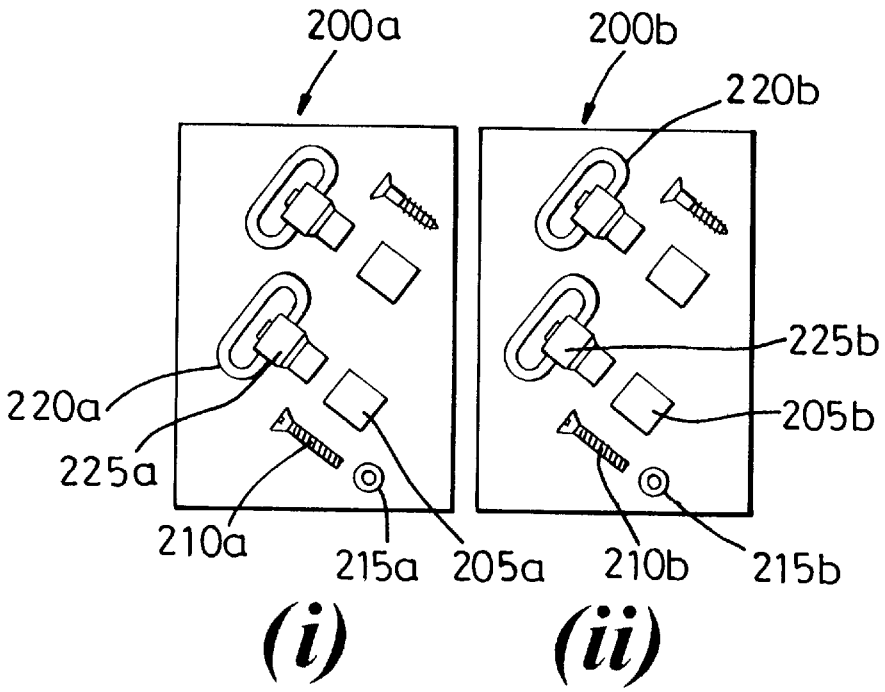
FIG. 10(A),(B) a view of known sling swivels.

Referring to FIGS. 10(A) (i), (ii) and 10(B) (i), (ii) there are shown known types of sling swivel 200*a,b,c,d*. The sling swivels 200*a,b* and 200*c,d* are manufactured by Michaels of Oregon (Uncle Mikes) and are available from their 1996 catalogue (p46) under references: QD100 (push button detachable), Set No. 1011/2; and QD115, Set No. 1261/2, resepectively.

Referring to FIGS. 10(A)(i)(ii), the sling swivels 200*a*, 200*b* comprise a cup 205*a,b* intended to be received within a recess formed in a stock of a firearm; a screw 210*a,b* intended to retain the cup 205*a,b* in the recess, in use; an annular ring 215*a,b;* and a body 225*a,b* carrying an eye 220*a,b* suitable for attaching a strap and at least one spring-loaded ball bearing.

Figure 10B:
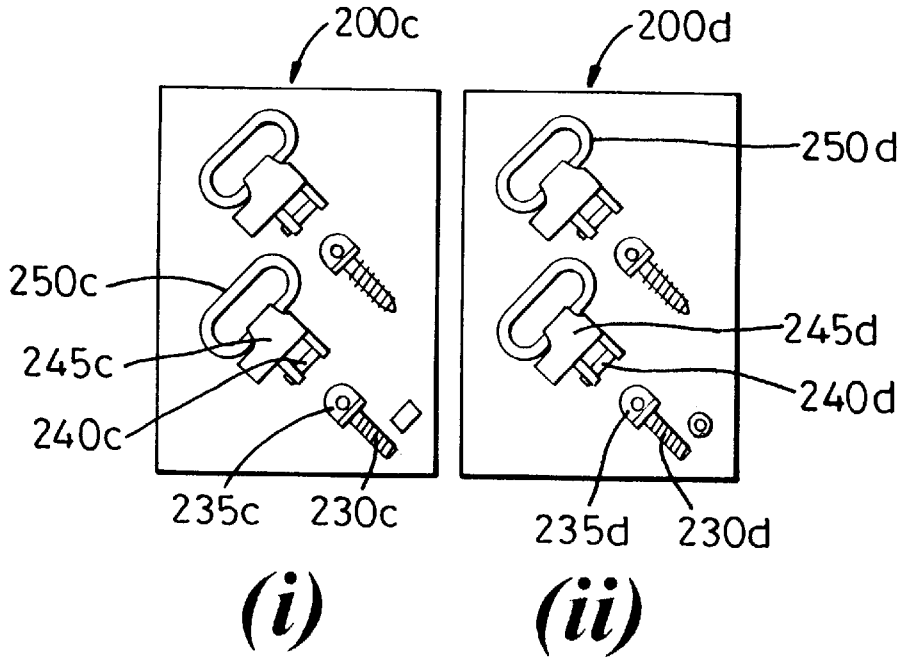

Referring to FIGS. 10(B)(i)(ii), the sling swivels 200*c*, 200*d* comprise a threaded screw 230*c,d* having a head 235*c,d* formed with an aperture. The aperture is capable of receiving a spring loaded peg 240*c,d* carried by a body 245*c,d* which also carries an eye 250*c,d*.

The body 245*c,d* is suitable for use with the stud 161 hereinbefore described so as to provide a sling swivel according to an embodiment of the present invention.

The embodiments of the present invention hereinbefore described are given by way of example only, and are not meant to limit the scope thereof in any way.

Particularly, it should be understood that although the disclosed embodiment has a one piece stock it may be envisaged that the stock may comprise a separate forestock and buttstock, in which case additional means for connecting the forestock and the action would be required.

What we claim is:

1. A rifle which includes a stock having a forestock and a buttstock, and an action, the buttstock being provided with a first hole having first and second ends, the second end opening onto a seat portion adapted to receive the action in fixed relationship to the stock, the stock further including a bedding plate provided on the seat portion of the stock, which bedding plate extends around the second end of the first hole to provide a mounting surface which abuts the action, the buttstock being releasable and threadably connected at its foremost end to the action by a bolt extending through the bedding plate and being retained in the first hole.

2. A rifle as claimed in claim 1, wherein the bedding plate includes a cylindrical member which extends within the first hole and which is a tight fit thereto.

3. A rifle as claimed in claim 2, wherein the bedding plate and cylindrical member are manufactured as a subassembly prior to being fitted to the buttstock.

4. A rifle as claimed in claim 1, wherein the bedding plate is a metal bedding plate.

5. A rifle as claimed in claim 1, wherein the first end of the first hole is provided on a pistol grip provided at the foremost end of the buttstock and the bedding plate provided on the seat portion around the second end of the first hole includes a cylindrical member which extends within the first hole and which is a tight fit therein.

6. A rifle as claimed in claim 1, wherein, the buttstock and forestock are formed as one piece.

7. A rifle as claimed in claim 6, wherein a recess is formed in the stock for the fitting of a stud assembly.

8. A rifle as claimed in claim 7, wherein the stud assembly comprises:

a main socket fixable within said recess formed in the stock;

a stud element receivable within the main socket and having connection means provided at one end thereof for connection of a sling swivel to the stud element;

a retaining member having means for engaging the main socket so as to be fixed within the recess and to retain the stud element within the recess;

wherein the retaining member and the stud element have co-operating means whereby the stud element is movable within the recess between a first position in which the stud element is retained substantially wholly within the recess, and a second position in which the said one end of the stud element protrudes out of the recess.

9. A rifle as claimed in claim 8, wherein the main socket comprises a hollow cylindrical member open at one end for receipt of the stud element.

10. A rifle as claimed in claim 8 wherein the main socket has a base wall opposite to the open end, the base wall having an aperture whereby the main socket is fixable by screw fixing to the firearm.

11. A rifle as claimed in claim 8 wherein said cooperating means provides a bayonet type connection between the retaining member and the stud element, whereby the stud element is movable by rotation between the first and second positions.

12. A rifle as claimed in claim 11, further comprising a spring element for biasing the stud element towards the second position.

13. A rifle as claimed in claim 12, wherein in use the spring element acts between the stud element and the main socket.

14. A rifle as claimed in claim 11, wherein the stud element is provided at said one end with a slot to facilitate rotation of the stud element by a user.

15. A rifle as claimed in claim 8, further comprising a spring element for biasing the stud element towards the second position.

16. A rifle as claimed in claim 15, wherein in use the spring element acts between the stud element and part of the main socket.

17. A rifle as claimed in claim 8, wherein the retaining member and the main socket are provided with the inter-engaging threaded portions for retaining the retaining member within the recess.

18. A rifle as claimed in claim 8, wherein said connection means comprises an aperture extending transversely through the stud element.

* * * * *